US006728971B1

(12) United States Patent
Benavidez

(10) Patent No.: US 6,728,971 B1
(45) Date of Patent: May 4, 2004

(54) SPORTS GLOVE

(75) Inventor: Cande Benavidez, Woodburn, OR (US)

(73) Assignee: Creative Industries, Boerne, TX (US)

( * ) Notice: Subject to any disclaimer, the term of this patent is extended or adjusted under 35 U.S.C. 154(b) by 0 days.

(21) Appl. No.: 10/439,025

(22) Filed: May 14, 2003

(51) Int. Cl.[7] ..... A41D 19/00
(52) U.S. Cl. ..... 2/161.4; 2/161.6
(58) Field of Search ..... 2/160, 161.1–161.4, 2/161.6; 473/205

(56) References Cited

U.S. PATENT DOCUMENTS

| | | | | |
|---|---|---|---|---|
| 4,387,838 A | | 6/1983 | Jackson | |
| 4,761,835 A | * | 8/1988 | Chen | 2/160 |
| 4,766,611 A | * | 8/1988 | Kim | 2/160 |
| 4,922,850 A | * | 5/1990 | Conley | 116/222 |
| D311,271 S | | 10/1990 | Mann | |
| 5,353,439 A | | 10/1994 | Kurtz et al. | |
| 5,623,731 A | | 4/1997 | Ehrgott et al. | |
| 5,730,658 A | * | 3/1998 | Kurtz et al. | 473/205 |
| 6,079,049 A | * | 6/2000 | Moir | 2/69 |
| 6,275,996 B1 | * | 8/2001 | Redwood et al. | 2/160 |
| 6,401,254 B1 | * | 6/2002 | Boller | 2/161.2 |
| 6,505,350 B2 | * | 1/2003 | Litke | 2/161.4 |

* cited by examiner

*Primary Examiner*—John J. Calvert
*Assistant Examiner*—Katherine Moran
(74) *Attorney, Agent, or Firm*—Kelly Bauersfeld Lowry & Kelley, LLP

(57) ABSTRACT

A sports glove provides an improved way of keeping a display convenient for allowing a user to keep time and the score while playing. The sports glove includes a body having a palm portion, a back portion and an opening for receiving a hand. The glove further includes an adjusting means for adapting the glove to a particular user, including a flap having a fastener for connecting the flap to the back portion of the sports glove body. The flap may also include first and second layers defining a pocket therebetween. A non-removable multi-function display may be disposed within the pocket, and an aperture through the first layer for allowing a user to access the display.

16 Claims, 1 Drawing Sheet

SPORTS GLOVE

BACKGROUND OF THE INVENTION

This invention relates to a glove incorporating a display. More particularly, this invention relates to a sports glove having a multi-function display integrated into the glove.

Golf is a popular sport where players use clubs to sink a ball with as few strokes as possible into each of either nine or eighteen successive holes on a course. Golf players, or golfers, commonly wear a golf glove on one hand to facilitate gripping the club. However, golfers usually remove their wristwatches before playing a round of golf. Golfers prefer not to wear wristwatches while playing for several reasons, including distractions from movement of the wristwatch on the player's forearm while the player is swinging a club. If a player wears a golf glove, it become burdensome for the player to have to take off the glove or push it away from their wrist every time they want to check the time. Golfers may also choose to store their watch in their pants pocket or golf bag should they desire to check on the current time at some point during play. However, the player may not be comfortable keeping a bulky watch in their pants while playing or having to rummage through their golf bag in order to find the watch.

During the game, a golfer may also wish to keep score and track the number of strokes per each hole. Golfers normally use a pencil and small scorecard to keep track of the number of strokes for each hole. While a golfer may also choose to store the pencil and scorecard in their pants pocket or golf bag, the golfer may not be comfortable keeping a sharp pencil or bulky scorecard in their pants while playing or having to rummage through their golf bag in order to find the pencil and scorecard after every hole.

Many different types of gloves have been employed to carry watches. These gloves have been used in a variety of sport and non-sport settings. However, these gloves have not integrated the watches into the glove itself. For example, U.S. Pat. No. 4,766,611 discloses a golf glove and watch combination that uses a conventional golf glove without modification. However, this system is not practical because it requires a watch strap to be fed through retaining slots on a protruding watch case with hook and loop fasteners on its surface facing away from the watch case. The strap extends partly around the glove flap so that the ends of the strap engage the fasteners on the underside of the flap. In another example, U.S. Pat. No. 5,353,439 discloses a removable golf scoring device that uses a conventional golf glove without modification. However, this system is not practical because it also requires a strap to be wrapped around a flap on the glove, allowing a protruding scoring device to be removably attached to the glove.

While gloves such as those described above may provide means of attaching a watch or scoring device, such gloves can always be improved to provide a less bulky, more integrated glove.

Accordingly, there is a continuing need for an improved way of keeping a display convenient for a golfer while playing. There is an additional need for a thin, integral display. There is a further need for a convenient manner of keeping score during play. There is an additional need to provide a display capable of performing several functions, such as showing the time and score. The present invention provides these needs and other related advantages.

SUMMARY OF THE INVENTION

A sports glove is illustrated and described that integrates a multi-function display. This glove is usable in any sports situation where a user desires to keep track of the time or other data. These situations can occur anywhere a sport is played.

The sports glove includes a body having a palm portion, a back portion and an opening for receiving a hand. The sports glove may further include an adjusting means for adapting the glove to a particular user. The adjusting means may further include a flap having a fastener for removably connecting the flap to the back portion. The fasteners may include, without limitation, hook and loop fasteners and at least one snap fastener.

The flap may include at least first and second layers. A pocket may be formed between the first and second layers and a non-removable multi-function display disposed within the pocket. In order to allow a user to access the display, an aperture may be formed through the first layer. In addition to the display the flap may also include identifying indicia.

The multi-function display may include date and time functions. The display may also include score and hole number functions. Controls for adjusting the display and switching between functions may also be included on the display. The multi-function display allows the user to select among several display functions including, the date, hour, minute or score. The user can toggle the display between different modes.

The glove may further include a ball marker that is removably connected to the sports glove body.

Other features and advantages of the invention will become more apparent from the following detailed description, taken in conjunction with the accompanying drawings which illustrate, byway of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

The present invention combines a standard golf glove design with a wafer thin integral data and time piece. The present invention provides an improved way of keeping a display convenient for a golfer while playing. The present invention further provides a thin, integral display and a convenient manner of keeping the time and score during play.

Figure 1:
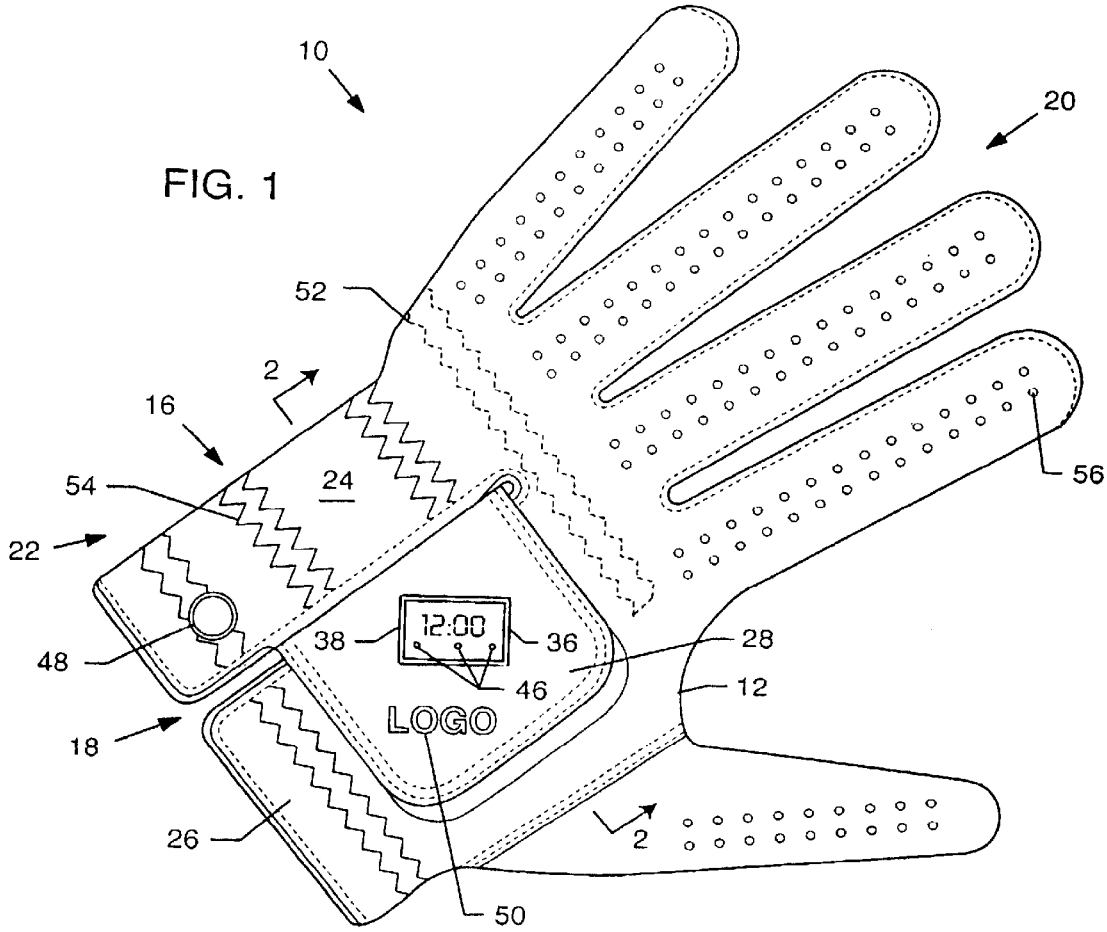
FIG. 1 is an orthogonal view of a golf glove embodying the present invention.
Figure 2:
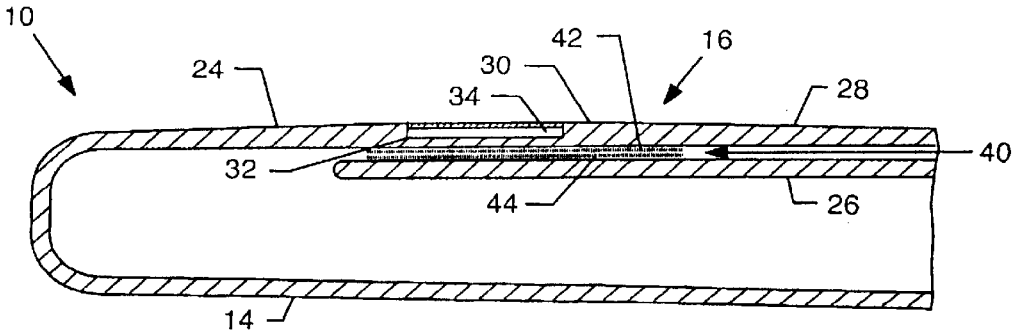
FIG. 2 is a cross-sectional elevation view of the golf glove taken along line 2—2 of FIG. 1.

As shown in the drawings for purposes of illustration, the present invention resides in a sports glove 10. With reference to FIGS. 1 and 2, the sports glove 10 is a golf glove includes a main body 12 having a palm portion 14, a back portion 16, an opening 18 for receiving a hand and a finger-receiving portion 20.

The back portion 16 includes an adjusting means 22 for adapting the glove 10 to the hand of a particular user. The adjusting means 22 includes at least two sections 24, 26 of the back portion 16.

A flap 28 may be connected to one of the two sections 24, 26. The flap 28 may have at least first and second layers 30, 32 where a pocket 34 may be formed therebetween. A non-removable multi-function display 36 may be disposed within the pocket 34. An aperture 38 may be formed through the first layer 30 and located above the pocket 34 in order to allow a user to access the display 36.

The flap 28 may include a fastener 40 for removably connecting the flap 28 to one of the sections 24, 26 of the back portion 16. The fastener 40 may come in various forms including, without limitation, hook and loop fasteners, snap fasteners, button fasteners, magnetic fasteners, velcro fasteners or the like. One portion 42 of the hook and loop fasteners may be placed on an underside of the flap and a mating portion 44 of the hook and loop fasteners may be placed on one of the sections of the back portion. Likewise, one portion of at least one snap fastener (not shown) may be placed on an underside of the flap 28 and a mating portion (not shown) of the snap fastener may be placed on one of the sections 24, 26 of the back portion 16.

The non-removable multi-function display 36 may be in the form of a wafer thin integral data and time piece. Once the display 36 is placed within the pocket 38, the display 36 becomes non-removable after the first and second layers 30, 32 are stitched or otherwise permanently closed so that the display 36 is permanently sealed within the pocket 34. The aperture 38 formed through the first layer 30 over the display 36 may be rectangular, circular, triangular, square or any other polygonal shape which allows the display 36 and the controls associated with the display 36 to be viewable and accessible by a user.

The display 36 is multi-functional in that it has several different modes rendering it capable of displaying various data to the golfer/user. In one mode, the display allows the user to view the time and date. In another mode, the display allows the user to keep score in addition to reviewing the time and date. Another mode allows the user to associate the number of strokes played on a hole with that particular hole.

In use, the user places the glove 10 on their hand like any conventional golf glove. In order to allow the user to look at the different displays, the display may include three pin-hole type buttons 46 that may be activated by using the sharp end of a golf tee or other object thin enough so as to depress anyone of the pin holes. One pin hole 46 will act as a toggle between different modes or functions such as the date, time (hour and minute), score and current golf hole completed. This display 36 will automatically default to the current time. The pressing of the toggle 46 will allow the user to move from the time to the date, to the score, and to the hole number. When the user is at the desired function window of the display 36, he or she may then depress either of the other pin holes 46 to activate the flashing mode to change the information in the function window. One of the toggles 46 allows the user to increase or decrease the date, hours, minutes, score or hole number. The user can save the new information by depressing the appropriate toggle pin hole 46 once the desired changes have been made.

The glove 10 may further include a ball mark 48 that is removably attachable to the back portion 16. The flap 28 may also include identifying indicia 50, such as a corporate logo, trademark, service mark, or other design near the display 36.

The glove 10 may be formed of leather, a synthetic material such as a plastic or synthetic leather or a combination of both. The flap 28 may be formed of the same materials as the rest of the glove 10. The glove 10 can also be made in various sizes for both men and women. The glove 10 may also incorporate an elastic band 52 that aids in the fit of the glove 10 on a user's hand. The glove may further incorporate various features of a conventional golf glove, including decorative stitching 54 and apertures 56 that allow the glove 10 to breathe.

While the glove 10 of the present invention has been described in a golf setting, applications are possible in other settings. For example, the present invention is also applicable in baseball, hockey, or settings where a player may desire to keep track of the date, time, score and other data related to the game.

The above-described embodiments of the present invention are illustrative only and not limiting. It will thus be apparent to those skilled in the art that various changes and modifications may be made without departing from this invention in its broader aspects. Therefore, the appended claims encompass all such changes and modifications as falling within the true spirit and scope of this invention.

What is claimed is:

1. A sports glove, comprising:

a body having a palm portion, a back portion and an opening for receiving a hand; and adjusting means for adapting the glove to a particular user, including a flap having a fastener for connecting the flap to the back portion of the sports glove body, wherein the flap includes first and second layers defining a pocket therebetween, a non-removable multi-function display permanently disposed within the pocket, and an aperture through the first layer for allowing a user to view the display;

wherein the display includes date and time functions.

2. The sports glove of claim 1, wherein the display includes score and hole number functions relating to golf.

3. The sports glove of claim 1, wherein the display includes controls for adjusting the display and switching between functions, and wherein the first layer of the flap includes apertures disposed over the controls for permitting access to the controls with a rigid object insertable through the apertures.

4. The sports glove of claim 1, including a ball marker removably connected to the body.

5. The sports body glove of claim 1, wherein the flap includes identifying indicia.

6. The sports glove of claim 1, wherein the fastener includes hook and loop fasteners.

7. A sports glove, comprising:

a body having a palm portion, a back portion and an opening for receiving a hand; and adjusting means for adapting the glove to a particular user, including a flap having a fastener for connecting the flap to the back portion of the sports glove body, wherein the flap includes first and second layers defining a pocket therebetween, a non-removable multi-function display permanently disposed within the pocket and having controls accessible through apertures in the first layer of the flap disposed over the controls for adjusting the display and switching between date, time, score, and hole number functions, and an aperture formed through the first layer for allowing a user to view the display.

8. The sports glove of claim 7, including a ball marker removably connected to the body.

9. The sports glove of claim 7, wherein the flap includes identifying indicia.

10. The sports glove of claim 7, wherein the fastener includes hook and loop fasteners.

11. A sports glove, comprising:

a body having a palm portion, a back portion and an opening for receiving a hand; and adjusting means for adapting the glove to a particular user, including a flap having a fastener for connecting the flap to the back portion of the sports glove body, wherein the flap includes first and second layers defining a pocket therebetween, a non-removable multifunction display permanently disposed within the pocket, and an aperture through the first layer for allowing a user to view the display;

wherein the display includes score and hole number functions relating to golf.

12. The sports glove of claim 11, wherein the display further includes date and time functions.

13. The sports glove of claim 12, wherein the display includes controls for adjusting the display and switching between functions, and wherein the first layer of the flap includes apertures disposed over the controls for permitting access to the controls with a rigid object insertable through the apertures.

14. The sports glove of claim 11, including a ball marker removably connected to the body.

15. The sports glove of claim 11, wherein the flap includes identifying indicia.

16. The sports glove of claim 11, wherein the fastener includes hook and loop fasteners.

* * * * *